United States Patent [19]

Harman

[11] 4,091,367

[45] May 23, 1978

[54] PERIMETER SURVEILLANCE SYSTEM

[76] Inventor: Robert Keith Harman, 111 Abbyhill, P.O. Box 842, Hazeldean, Ontario, Canada, KOA 2BO

[21] Appl. No.: 696,225

[22] Filed: Jun. 15, 1976

[30] Foreign Application Priority Data

Jan. 28, 1974 Canada ..... 193733

Related U.S. Application Data

[63] Continuation-in-part of Ser. No. 552,400, Feb. 24, 1975, abandoned.

[51] Int. Cl.[2] ..... G08B 13/24

[52] U.S. Cl. ..... 340/258 A; 343/5 PD; 343/100 CL

[58] Field of Search ..... 340/258 A; 343/5 PD, 343/100 CL

[56] References Cited

U.S. PATENT DOCUMENTS

| | | | |
|---|---|---|---|
| 3,157,781 | 11/1964 | Gruen | 343/100 CL |
| 3,162,848 | 12/1964 | Mulvey | 340/258 |
| 3,502,989 | 3/1970 | Honeiser | 343/100 CL |
| 3,750,125 | 7/1973 | Ross et al. | 340/258 C |
| 3,801,976 | 4/1974 | Ross et al. | 340/258 R |
| 3,803,599 | 4/1974 | McLean et al. | 343/5 PD |

*Primary Examiner*—David L. Trafton
*Attorney, Agent, or Firm*—Fleit & Jacobson

[57] ABSTRACT

A location and ranging system using a pair of leaky coaxial cables to detect targets along a prescribed route. When used as a security surveillance system an intruder is treated as the target and the prescribed cable routing is the perimeter of the protected area. The cables are mounted parallel to each other with a separation sufficient so as to cause the two cables to be loosely coupled. A transmitter is connected to one of the cables to supply pulses of RF energy for propagation therealong. The presence of a target (any body which reflects or absorbs radio frequency energy) alters the magnitude and phase of the signal received at the other cable and, hence, provides a change in the return signal to a receiver connected to the other cable. This change in signal is processed digitally to discriminate between legitimate targets and very slow environmental changes and very high speed changes due to undesirable targets such as birds. A switching system is provided whereby each cable may be alternately connected to the transmitter and receiver thereby providing both detection of fault location and sufficient redundancy for continued operation.

9 Claims, 9 Drawing Figures

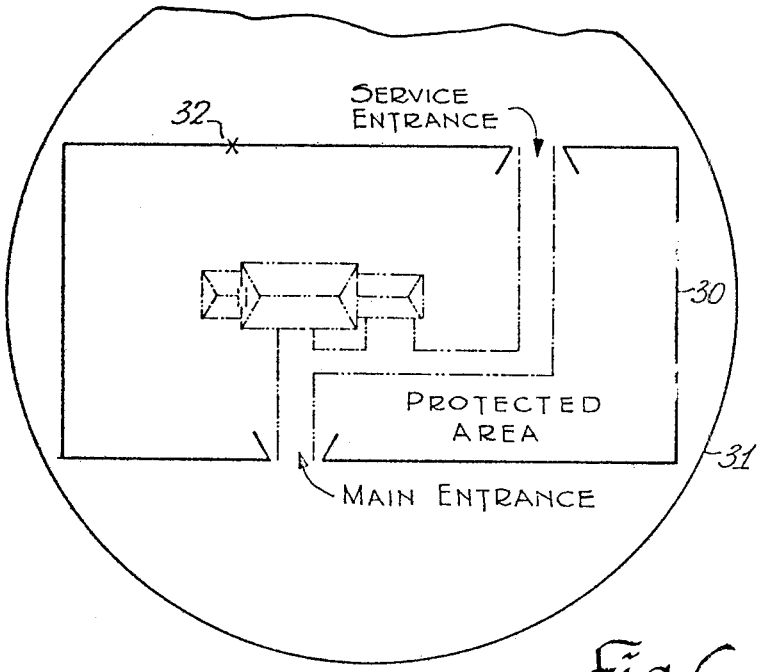
Fig-6
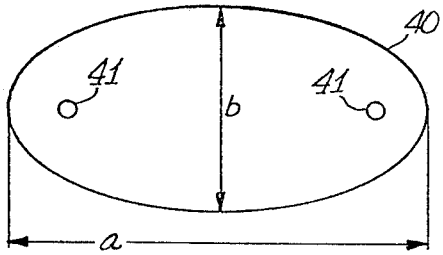
Fig-8
Fig-9
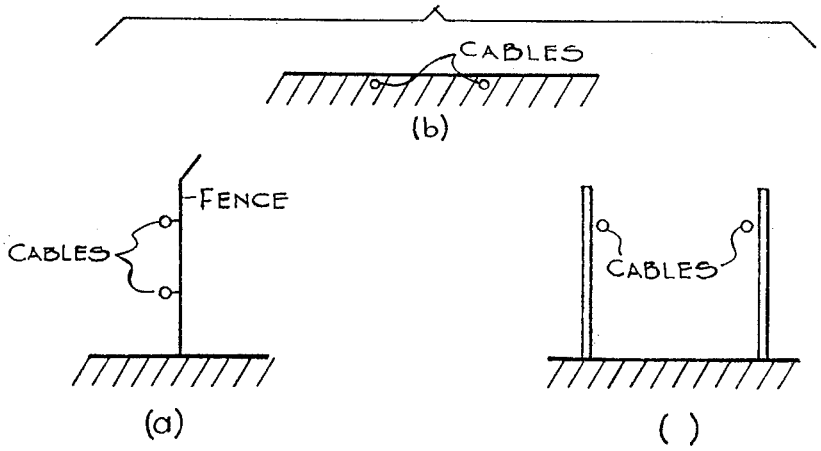

human targets can be detected. This detection can be due to a magnitude change, a phase change or both.

Applicant's system also includes the provision of filter means removing low frequency components from the received signal. This has the effect of removing the stationary profile (that is the signal transmitted between the cable when no target is present) of the system. In distinction to this feature, the system of U.S. Pat. No. 3,750,125 accepts the stationary profile as a necessary part of the system and only distinguishes signals which greatly exceed this in amplitude. For example, reference may be made to the discussion of FIG. 10 of the patent on column 6, lines 21–25.

BRIEF DESCRIPTION OF THE DRAWING

FIG. 6 shows a display useful with the system of FIG. 1;

FIG. 8 shows the zone of detection in a plane perpendicular to the cables; and FIG. 9 shows examples of the manner in which the cables can be installed.

DESCRIPTION OF THE PREFERRED EMBODIMENT

Figure 1:
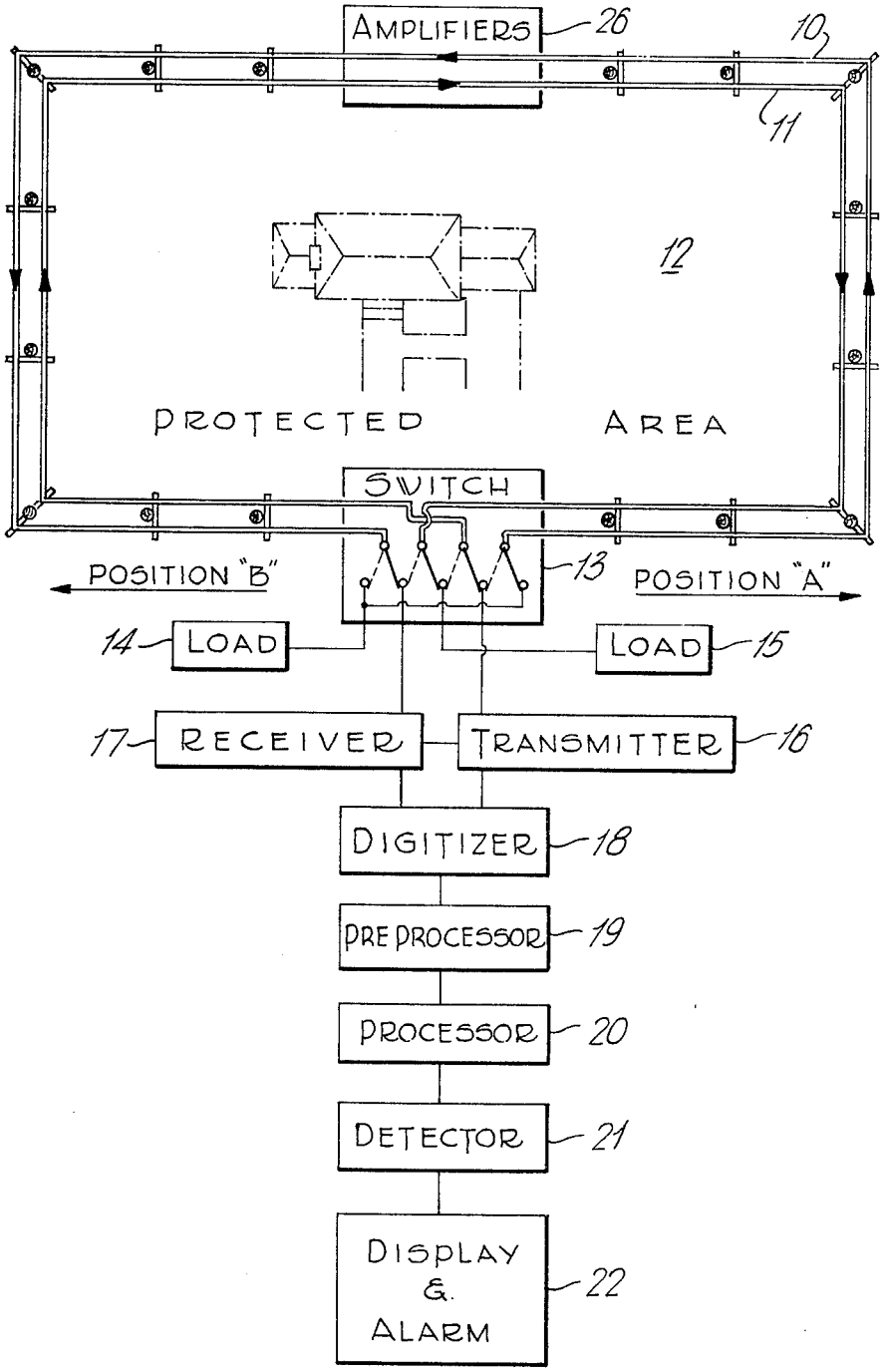
FIG. 1 is a schematic diagram of a surveillance system in accordance with the invention.

Referring to FIG. 1 two leaky coaxial cables 10 and 11 are arranged around the periphery of an area 12 to be monitored. A switching arrangement, shown schematically at 13 selectively connects matched loads 14 and 15 to a termination of each cable, a transmitter 16 to one of the cables and a receiver 17 to the other. A numerical description of the in-phase and out-of-phase components generated by the receiver is produced by a digitizer 18. These components are manipulated in a preprocessor 19 and a processor 20 to enhance the signal to noise ratio. The processed target response is fed to a detector 21 which drives a display unit 22.

Considering switch 13 to be connected as shown in full lines, the mode of operation of the system will now be described. Transmitter 16 sends a pulse of energy down cable 11 causing a travelling surface wave to propagate therealong. A portion of this travelling wave is coupled into cable 10 and returned to the receiver. The return signal is a function of the coupling factor between the sensor cables during the propagation of the pulse along the cable length. The electromagnetic field produced by cable 11 is altered by an intruder adjacent the cables, hence modifying the coupling factor and producing a change in the return signal. The processor 18 senses this change and translates the time delay between the onset of the pulse on cable 11 and the return of the change on cable 10 into the distance of the intruder from the cable end.

With the switch in the dotted line position (position B) the transmitted pulse is sent along cable 10 and the return signal is measured on cable 11. Under normal operations this provides redundant information to that obtained while the switch is in position A. However, should either or both cables be cut the combination of pulses on 10 and 11 would maintain complete perimeter surveillance as well as exactly locating the point of discontinuity. Thus, both fault detection and information as to fault location are provided together with redundancy for continued operation.

In applying this system to very long perimeters, it will be necessary to insert amplifiers along the cable length as indicated at 26. The number of amplifiers required is proportional to the cable attenuation factor and hence is a function of the cable characteristics. Since the signals of interest, whether transmitted or received, always travel anticlockwise in cable 11 and clockwise in cable 10, only uni-directional amplifiers are required.

Figure 2:
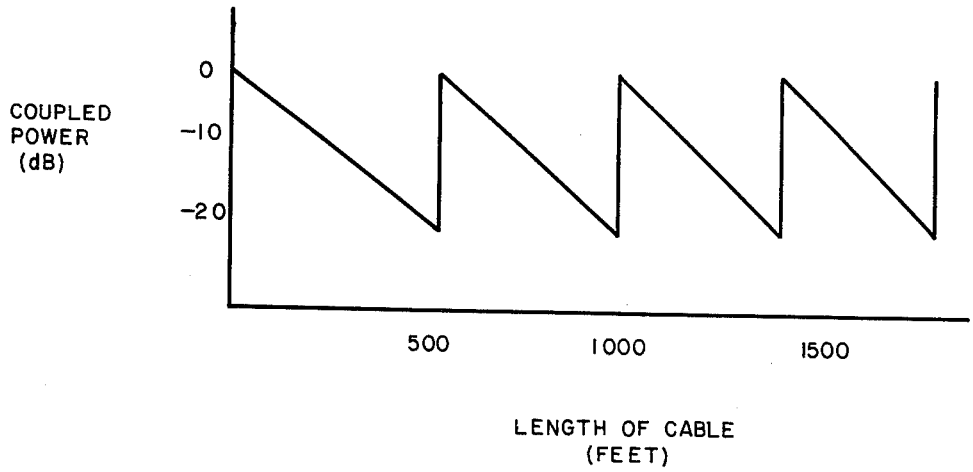
FIG. 2 is a graph of the power coupled by a gradated cable.

In certain applications it may not be possible to have access to both ends of the cables. For example, if only a portion of the perimeter is to be monitored, the matched loads 14 and 15 would be located at the remote end of the cables and hence would not be accessible for switching. In this case it is possible and in fact desirable to use gradated cables. A gradated cable consists of a number of discrete cable sections having different coupling factors; where coupling factor is a function of the hole size in the outer conductor. The sections of the gradated cable are arranged so as to have increasing coupling factors equivalent to the linear attenuation of each segment in a direction from transmit/receive ends towards the load ends. The coupled power for a typical gradated cable pair is illustrated in FIG. 2. for a constant input power level using a four stage gradated cable design. The dynamic range for the return signal from 1800 feet of cable is limited to 20 db. If a uniform cable was used the dynamic range could be as high as 46 db for the same cable length. This reduction in dynamic range has three beneficial effects. First, the dynamic range of the analog-to-digital converter is more optimally utilized. Second, the system operational characteristics are more uniformly distributed over the cable length. Third, the total attenuation is reduced as the cable attenuation increases with the coupling factor. Additional lengths of similarity gradated cable can be utilized provided appropriate line amplifiers are used. For the four staged gradated cables in the example the amplifiers would require a total gain of 80 db; 40 db in each cable. Further reduction in dynamic range is achieved if the cable is continuously gradated thereby eliminating all connectors.

The transmitter 16 initiates the RF pulse along one of the leaky coaxial cables. A typical system operates with the following specifications; carrier frequency 60 MHz, bandwidth 2.5 MHz, pulse width 400 nanoseconds, repetition rate 30 KHz and peak power 0.5 watts. The carrier frequency and pulse widths are carefully selected considering cable attenuation and possible RF interference. While typical leaky cables can operate from 30 MHz to 400 MHz, and, thus a transmitter operating in the range 30–400 MHz can be used, it is desirable to select as low a frequency as possible to minimize the cable attenuation. A decrease in pulse width can provide better target resolution however it requires an increase in bandwidth and peak power. The carrier frequency should be selected so as not to interfere with other applications of the UHF and VHF frequency bands. In this regard a typical leaky cable can be considered as an isotropic radiator with an effective gain of −30db. In the typical system with the above specifica-

PERIMETER SURVEILLANCE SYSTEM

CROSS-REFERENCE TO A RELATED APPLICATION

This application is a continuation-in-part application of a copending application Ser. No. 552,400 filed Feb. 24, 1975, now abandoned.

BACKGROUND OF THE INVENTION

This invention relates to a location and ranging system useful as a surveillance system for enclosed areas and, in particular, to such a system using a pair of leaky coaxial cables, one connected to a transmitter and the other to a receiver.

It is well known that there is a requirement for detecting unauthorized movement either entering into, or departing from, large enclosed areas such as prisons, airports, warehouses, freight yards and defence installations. The numerous types of apparatus presently employed in these applications all have serious disadvantages, especially for long perimeters (in excess of 1 mile) during adverse environmental conditions. Heavy rain or snow conditions can disable most optical systems based upon photoelectric sensors. Pressure sensitive devices can be ineffective in cold climates due to the penetration of frost. Both acoustic and seismic sensors are prone to false alarms due to gusts of wind or the proximity of vehicular traffic.

A number of perimeter protection systems are based upon the disturbance of electro-magnetic fields. Some systems rely upon the change of capacitance between two sensing wires. Others rely upon the change of impedance of a two wire transmission line due to the presence of an intruder. Most of these systems have relatively poor sensitivity because they attempt to detect very small changes in a large quantity which usually is a function of the physical deployment of the sensor. This can result in false alarms due to vibration, rain, snow or variations in temperature and humidity.

The use of coupled transmission lines together with digital processing can overcome most of these shortcomings. U.S. Pat. Nos. 3,750,125 and 3,801,976 disclose a system based upon coupled strip lines. In that system, the transmission lines are separated by a fraction of an inch and detection of an object (a wheel of a vehicle or a shoe on a human foot, for example) occurs when the presence of the object caused a change or distortion in the electro-magnetic field coupling pattern. Due to the close proximity of these transmission lines, the zone of protection in such systems is very limited. In addition the construction and installation of these strip lines can be very cumbersome.

Coupling may be defined as "close" or "loose." The customary definition of these two types of coupling may be found in the "IEEE Standard Dictionary of Electrical and Electronics Terms" at page 123. A further definition of "loose coupling" may be noted in the text book "Electrical Engineering Circuits" by Skilling (Wiley, 1957) at page 369. The statement is made that "loose-coupled" circuits have a coupling coefficient in the range between 0.01 and 0.10.

Figure 7:
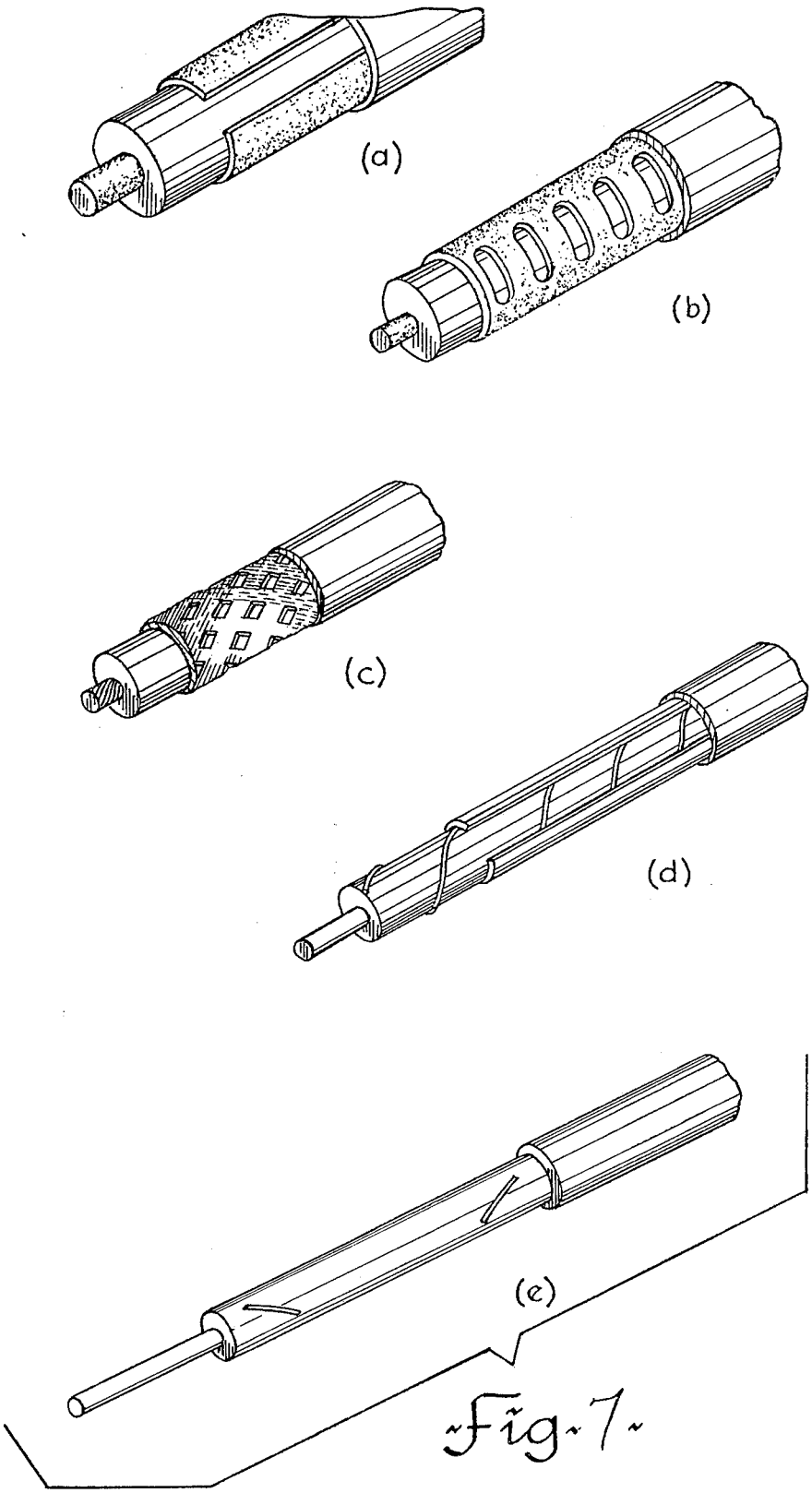
FIG. 7 shows types of leaky coaxial cable useful in the system of FIG. 1.

Thus, in the known system the coupling between the transmission lines is close. A study of typical microstrip transmission lines (IEEE Trans MTT-16 No. 12, December 1968 pp. 1021–1027) deals with the question of coupling between closely positioned microstrip transmission lines almost identical to those described in the U.S. Pat. Nos. 3,750,125 and 3,801,976. FIGS. 6–8 (p. 1025) show that the characteristic impedance of the coupled pair is dependent on the strip line spacing. This establishes that lines such as those disclosed in the patents operate under conditions of close coupling. It may further be noted that in U.S. Pat. No. 3,801,976 the patentee states "For use in the present invention, a maximum coupling is again usually selected,".

SUMMARY OF THE INVENTION

The present invention provides a significant zone of protection over long perimeters and, to this end, employs a pair of leaky coaxial cables surrounding the area to be protected. These cables are typically separated by at least two orders of magnitude greater than their outside diameter to be loosely coupled and can be mounted on a perimeter fence or below the perimeter surface. According to *Webster's Third International Dictionary,* Unabridged, G & C Merriam Company, Springfield, Mass. 1966, an order of magnitude is defined as a range of magnitude extending from some value to 10 times that value. For example, quantities are of the same order of magnitude if one is no larger than 10 times the other, but if one is 100 times the other it is larger by two orders of magnitude. A pulse transmitter is connected to one of the cables and a receiver to the other. The presence of an intruder (a person or metallic object) alters the magnitude and phase of the signal received by the other cable. This change in the return signal is processed to provide target discrimination before an alarm is sounded. The coupling between the transmission lines is "loose coupling." This is shown by the fact that in tests transmitting one-half watt power into the transmitting cable without the presence of a target, the received signal is 103 db less. Although some this loss is due to attenuation in the cable, over 80 db of the loss is due to the loose coupling. This indicates that the coupling coefficient is less than 0.10 which under the definition proposed by Skilling is definitely "loose-coupled."

The manner of operation of the known system including strip lines and the result obtained therefrom are quite different from the manner of use of spaced, coaxial lines in applicant's system. Specifically, the "illumination" provided by the loosely coupled cables of the applicant, that is, the distance between the cables, times the length of the short section of cable energized by a typical pulse, is of the order of one thousand times greater than that of the tightly coupled strip lines when fed with a 0.3 nanosecond pulse (U.S. Pat. No. 3,750,125 col. 6, L. 5). The advantage of this arrangement in providing much more effective surveillance will be evident. As a result of this far larger "illuminated" area, applicant's receiving equipment utilizes a synchronous detector to measure a minute change in the normally coupled energy, whereas the reference detects a change which is of the order of magnitude of the normally received energy. As is well known, a synchronous detector is a detector which is sensitive only to signals at or near a given frequency. The detection is performed by ascertaining that the frequency of such signal is identical with the frequency of a control signal supplied independently or internally. Synchronous detector are phase sensitive as well as being frequency selective. In applicant's system the change due to a human target is much less than normal coupled energy (without a target). Since the normal coupled energy at a fixed sample point is virtually stationary both in magnitude and phase over a period of a few minutes, the small changes due to able to use a peak detection scheme to more accurately locate the target. The output of the detector is a sequence of binary commands to drive the display. The display unit 22 provides the operator interface. A typical display consists of a sequence of light emitting diodes arranged in a display as illustrated in FIG. 6. Each light corresponds to one or more cells along the cable perimeter. When an intruder enters the detection zone of the cable an audible alarm is sounded and the corresonding light flashes. The operator acknowledges the alarm by resetting the audible alarm which then keeps the light lit. The operator then checks the indicated instrusion area and takes the appropriate response action. Once satisfied that the response action has been taken the operator can reset the particular light on the display. Should a second alarm occur before the response to the first alarm is complete the audible alarm will sound again and the appropriate light will flash.

This system can provide a number of very desirable operating features. Multiple intruders at various points on the perimeter can be located simultaneously. Multiple intruders at a single point of entry may also be detected and displayed by a flashing symbol. Intruders passing through controlled entrances may be masked out in the digital processing. The optional feature of allowing authorized entry can be provided by means of transponders and special purpose processing and masking techniques.

Various types of leaky coaxial cable suitable for use in the system of the present invention, are shown in FIG. 7. These cables are similar to ordinary coaxial cables with outer conductors modified to allow energy to be released from the cable. Depending upon the design of the particular cable, the energy that is released can propagate in either a surface wave or leaky wave mode or a combination of both modes. In general terms, the surface wave mode electric field strength decays more rapidly in a radial direction from the cable than for a leaky wave mode. Hence, the selection of the cable type may be an important factor in determining the radial range of the sensor to meet a specific application.

The cables of FIGS. 7(*a*) and 7(*d*) have continuous slots but the latter, sold under the trade mark CERT ®, includes a further spiral wire as a radiating element. The cables of FIGS. 7(*b*), 7(*c*) and 7(*e*) have spaced apertures of different form. That of FIG. 7(*b*) is sold under the trade mark RADIAX ®. The cable shown in FIG. 7(*c*) has a loosely braided shield and that shown in FIG. 7(*e*) has slots spaced at intervals of about 1 foot.

The false alarm rate and probability of detection which can be obtained with this system are directly related to the signal-to-noise ratio at the threshold detector. By varying the threshold for a fixed signal-to-noise ratio the standard tradeoff between false alarm and probability of detection can be achieved. Clearly the integration, filtering and correlation performed in the data processing should be designed to maximize the signal-to-noise ratio within the physical constraints on the system.

The zone protection provided by the cable sensors is illustrated in FIG. 8. In free space, the zone would be an ellipse 40 with foci at the cables 41. By separating the cables, the area of the ellipse increases, leading however to lower signal-to-noise ratio. In adapting the system to any particular application the parameters of cable type, power level, frequency of operation pulse width and cable separation are all available for adjustment. A typical system provides protection with "*a*" in the range of 12 feet and "*b*" in the range of 8 feet with respect to a human intruder.

The installation of the leaky coaxial cables is reasonably simple. Diferent sensor installations are illustrated in FIG. 9. FIG. 9*a* shows how the cables may be used in conjunction with a vertical fence. FIG. 9*b* illustrates an installation below the surface typically at a depth of 1-6″ and FIG. 9*c* illustrates cables spaced horizontally above the surface, thereby providing a wider zone of protection than vertical spacing.

While the foregoing invention has been described in connection with an intrusion detection system, it will be clear that the system has a number of other applications. For example, the leaky cable sensor can be used to locate vehicles on airport maneuvering surfaces or for the location of vehicles on a rapid transit system and to meet other requirements for the location of objects over long prescribed paths under adverse environmental conditions. Various changes in the exact structure of the preferred embodiment will be obvious to those skilled in the art. For example, other types of display units can use plasma or cathode ray tube displays.

I claim:

1. A detection system for locating targets moving within a range of velocities which reflect or absorb electromagnetic energy comprising, first and second leaky coaxial cables operable in the range 30 to 400 MHz extending along a prescribed path and spaced from one another a distance so as to be loosely coupled, a transmitter connected to one of said cables to supply pulses of RF energy whereby the target alters the magnitude and phase of the signal received at the other cable and a receiver providing synchronous detection of the incremental data received on the other cable, and means processing the received signal to determine the location of the target including filter means removing all frequencies of the target pass band corresponding to said range of velocities.

2. A system as set out in claim 1, further including switching means selectively connecting said transmitter and receiver to said cables whereby the direction of signal propagation around an area can be reversed.

3. A system as set out in claim 1 wherein the signals in said receiver are digitized and said processing means further includes digital filter means having a bandwidth between about 0.003 Hz and 5 Hz.

4. A system as set out in claim 3 including a further digital filter connected to the output of the digital filter means to provide approximate integration.

5. A system as set out in claim 4 further including a threshold detector responsive to the output from said further digital filter to actuate alarm and display means.

6. A system as set out in claim 1 wherein said means processing the received signal includes a digital processing system, comprising a digitizer, a plurality of low pass filters and a plurality of threshold detectors, the digitizer computing a sequence of numbers to represent the average magnitude of the return signal over a sequence of time intervals and three low pass digital filters are provided for each number in the sequence, the time constants of the first and second low pass filters being adjusted so that the difference in their outputs discriminates between very slow and very fast changes in the return, said difference being further filtered by the third low pass filter to provide approximate integration, the threshold detector associated with each number being used to determine the presence of a change in return signal associated with a target in which the location of tions the maximum radiated field strength at 500 feet from the cable is 50 microvolts per meter.

The receiver 17 is connected to the other leaky coaxial cable. In general its purpose is to select, amplify and demodulate the return signal. The selection is performed by a band pass filter centered around the carrier frequency. The first stage of amplification is designed so as to minimize thermal noise. It may be desirable to use a variable gain or logarithmic amplifier in the receiver to minimize the dynamic range required in digital processing. The demodulation may be performed using two mixers and two low pass filters. The return signal is mixed with the reference carrier frequency in one mixer and the output is filtered to derive the inphase component I. The same return signal is mixed with the reference carrier frequency shifted by 90° in the second mixer and the output is filtered to derive the out-of-phase component Q. The low pass filters remove the carrier and all higher cross product frequencies. The I and Q components of the return signal effectively describe the system cable profile.

Figure 3:
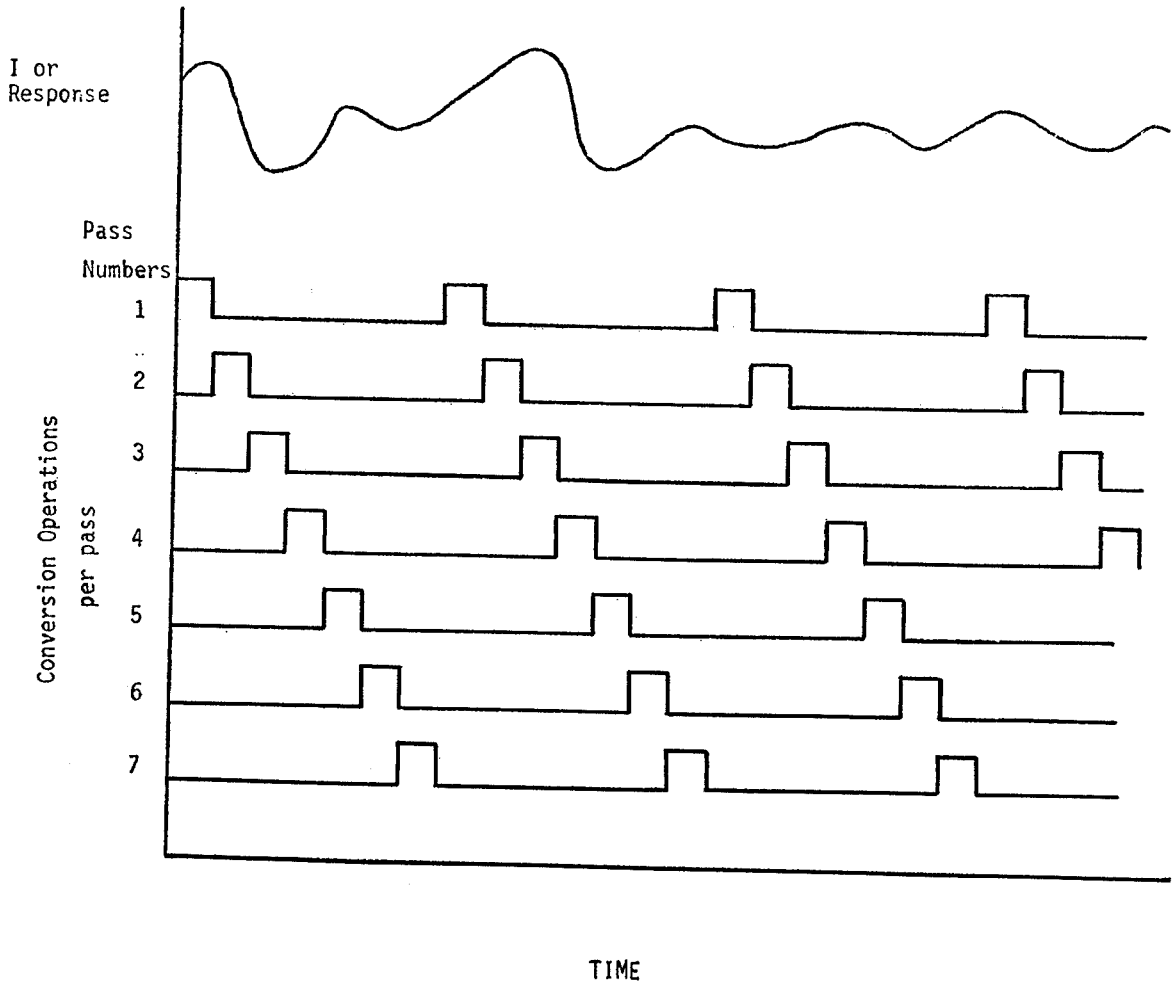
FIG. 3 is representation of the sampling operation.

The digitizer 18 operates on the I and Q components generated by the receiver. Numerical values are assigned to the I and Q components for a sequence of cell widths corresponding to the signal magnitude. In a typical system a cell width of 157 nanoseconds could be used corresonding to 62 feet of cable assuming a propagation velocity of 80% of that in free space. Hence for a 5280 foot perimeter system there would be 84I values and 84 Q values. It is sometimes desirable to perform this digitization sequentially. For example, a multipass system can be used as illustrated in FIG. 3. In this approach 12 numbers are assigned to the I (or Q) profile in each of the seven passes to correspond to the entire 5280 feet. This corresponds to a 0.7 MHz conversion rate. A separate pulse is transmitted for each pass and the I and Q profiles are digitized simultaneously. Hence a total time of 117 microseconds is required to completely digitize the I and Q profile for this example if a repetition rate of 60 Khz is considered. This example assumes that the signals are quantized into 256 levels (8bits). The output of the digitizer is a complete numerical description of the I and Q response signals at a rate of 8.5 KHz.

Figure 4:
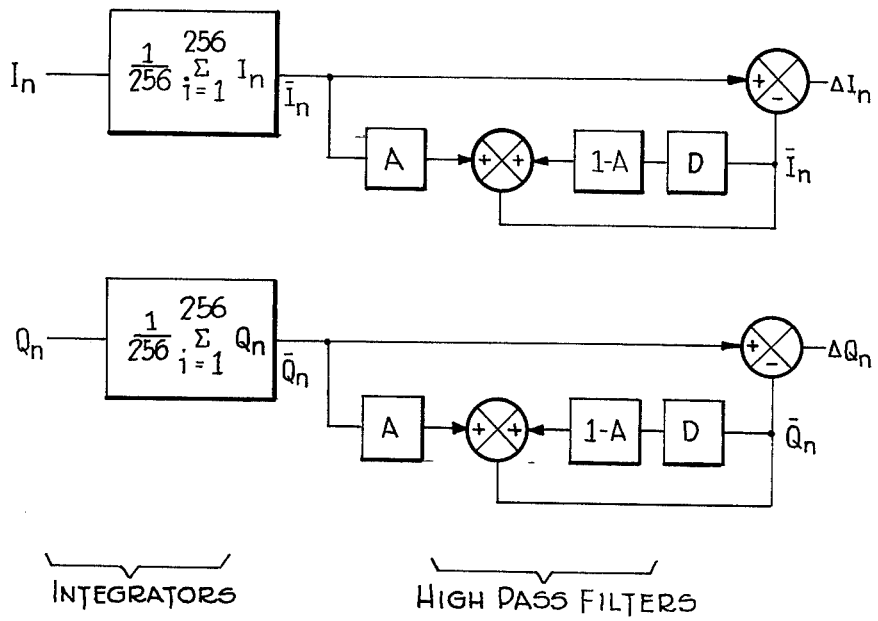
FIG. 4 is a schematic diagram of the digital preprocessor.

The preprocessor 19 operates on the digital I and Q profiles. The purpose of the preprocessor is to perform signal integration and to remove the stationary profile. A typical preprocessor operating on cell $n$ is illustrated in FIG. 4. The notations used is as follows:

$\bar{I}n$ average of 256 $\bar{I}n$ samples for cell $n$, $\bar{Q}n$ average of 256 $\bar{Q}n$ samples for cell $n$ $I_n$ stationary value of $\bar{I}n$ $Q_n$ stationary value of $\bar{Q}n$ $\Delta I_n$ in-phase component of target response $\Delta Q_n$ out-of-phase component of target response $A = 1-e^{-T/\tau a}$, T = sample period, $\tau$ = filter time constant D = delay of T seconds.

In applications where the computations are performed in fixed point arithmetic the filtering operation as described previously can cause the accumulation of truncation errors. This undersirable effect can be significantly reduced by performing the same operation using the following alternate formulation.

$$\Delta I_n = (1-A_j)(I_n - I_{n-1}) + \Delta I_{n-1}$$

and $$\Delta Q_n = (1-A_j)(Q_n - Q_{n-1}) + \Delta Q_{n-1}$$

where $A_n = 0$ when $n = m$ or multiples thereof $A_n = \bar{A}$ when $n = m$ or multiples thereof $\bar{A} = 1-e^{-mT/\lambda a}$ While this formulation requires two additional storage locations per cell the same stored data is also required in the auto correlation performed in the processor.

In this example the integration is performed by taking the average of 256 complete profiles before processing. For a 8.5 KHz digitization rate the $\Delta I_n$ and $\Delta Q_n$ outputs of the preprocessor would occur at 33 Hz. In other words the integration would be performed over 30 millisecond periods. Since this example considers only unaided human intruders the target could not move more than 1 foot per integration period. This is small relative to a wavelength at 60MHz which implies that the response cannot change appreciably over the integration period. This integration provides a 24 dB improvement in signal to random noise. To achieve this improvement the digital processing must be performed with more quantization levels than the digitizer. For the example it is assumed that these computations are performed using 65,536 levels (16 bits). Since the cable is not a homogeneous medium there is a stationary profile associated with each cable installation. This stationary profile is removed by two digital high pass filters. The constant A in these filters is calculated to provide a specified time constant $\tau_a$. which defines the slowest speed target that can be detected. A typical value of $\tau_a$ would be 5 minutes. The output of the preprocessor is a complete numerical description of the $\Delta I_n$ and $\Delta Q_n$ target response components at a 33 Hz rate.

Figure 5:
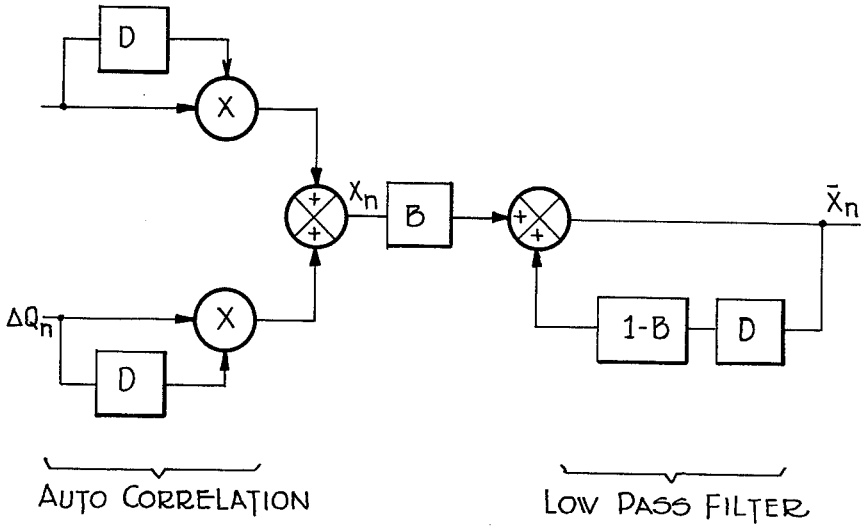
FIG. 5 is a schematic diagram of the digital processor.

The digital processor 20 operates on the $\Delta I_n$ and $\Delta Q_n$ components to reconstruct and filter the target response. These operations are illustrated in FIG. 5 in which the symbols are as follows:

$\Delta I_n$ in-phase component of target response for cell $n$ $\Delta Q_n$ out-of-phase component of target response for cell $n$ $X_n = \Delta I_n \cdot \Delta I_{n-1} + \Delta Q_n \cdot \Delta Q_{n-1}$ $B = 1-e^{-T/\tau_b}$, T = sample period, $\tau_b$ = filter time constant D = delay of T seconds $\bar{X}_n$ = filtered value of response magnitude for cell $n$ The target response, $X_n$, is the sum of the auto correlation of the $\Delta I_n$ and $\Delta Q_n$ signals. This response is smoothed by a low pass filter with a typical time constant $\tau_b$ of 500 milliseconds. If T is equal to 30 milliseconds the corresponding value of B is 0.058 This filter reduces the signal to random noise ratio by a factor of B/(2-B) or 7.6 dB. The output of the digital processor is the filtered value of the target response $\bar{X}_n$ for all 84 cells (ie $n$ — 1, 2 . . . . 245).

The detector 21 operates on the magnitudes of the target response for each cell along the cable length. In its simplest form the detector can consist of a magnitude threshold detector for each cell. In this case, whenever the magnitude of $X_n$ exceeds a specified value T a target is declared in cell n which corresponds to a specific location on the perimeter. In a more complex system, the magnitude levels for a number of adjacent calls can be combined using cross correlation techniques prior to threshold detection. In some cases it may also be desirthe target is determined from the particular number in the sequence for which the threshold detector is energized.

7. A system as set out in claim 1, wherein said cables consist of sections with a coupling factor increasing with distance from the transmitter.

8. A system as set out in claim 1, wherein said distance whereby said first and second coaxial cables are spaced apart is at least two orders of magnitude greater than the outside diameter of said cables.

9. A system as set out in claim 1, wherein said synchronous detection of the incremental data received on the other cable is performed according to an autocorrelation technique.

* * * * *